United States Patent [19]

Timmons

[11] Patent Number: 4,584,449

[45] Date of Patent: Apr. 22, 1986

[54] GETTER FLASHER HAVING A SELF-CENTERING COIL ENCLOSURE

[75] Inventor: William J. Timmons, Wabash County, Ind.

[73] Assignee: RCA Corporation, Princeton, N.J.

[21] Appl. No.: 706,459

[22] Filed: Feb. 28, 1985

[51] Int. Cl.[4] ..... H05B 6/40

[52] U.S. Cl. ..... 219/10.57; 219/10.43; 219/10.79; 219/10.67; 445/19; 445/57; 313/553

[58] Field of Search ..... 219/10.57, 10.43, 10.67, 219/10.79, 10.73; 445/55, 57, 19, 40, 41; 313/553, 560, 561

[56] References Cited

U.S. PATENT DOCUMENTS

| | | | |
|---|---|---|---|
| 2,164,332 | 7/1939 | Macksoud | 219/10.67 X |
| 2,382,779 | 8/1945 | Denneen et al. | 219/10.73 |
| 3,558,961 | 1/1971 | Palsha | 313/481 |
| 4,119,825 | 10/1978 | Taylor et al. | 219/10.57 X |
| 4,152,566 | 5/1979 | Mägerle | 219/10.73 X |
| 4,224,494 | 9/1980 | Reboux et al. | 219/10.73 X |
| 4,302,063 | 11/1981 | Rudy | 445/55 |
| 4,335,926 | 6/1982 | Griesemer, Sr. | 445/19 |
| 4,516,945 | 5/1985 | Martelli | 445/19 |

*Primary Examiner*—Philip H. Leung
*Attorney, Agent, or Firm*—E. M. Whitacre; D. H. Irlbeck; T. H. Magee

[57] ABSTRACT

A getter flasher has a movable, self-centering coil enclosure including an rf induction coil adapted to heat a getter container disposed within a cathode-ray tube and adjacent to a funnellike surface thereof. The coil enclosure is supported by a holder and has a spring coupled thereto for moving the coil enclosure in a direction away from the holder. A surface of the coil enclosure has a contour substantially similar to a portion of the funnellike surface of the tube.

12 Claims, 5 Drawing Figures

GETTER FLASHER HAVING A SELF-CENTERING COIL ENCLOSURE

BACKGROUND OF THE INVENTION

This invention pertains to a getter flasher having a movable, self-centering coil enclosure.

In manufacturing a cathode-ray tube, a getter material is disposed within the tube in a metallic container held by one end of an elongated, resilient support spring which is attached at the other end to a mount assembly so as to extend in cantilever fashion into a funnel of the tube. Such a combination of getter container and support spring is commonly known as an "antenna getter". After the tube is partially exhausted of gases and hermetrically sealed, the getter material is quickly heated until it vaporizes or "flashes" from its container, and then deposits as a getter film on internal surfaces of the tube. The length of the spring permits the getter container to be positioned well within the funnel, where the getter material can be flashed to provide optimum coverage and where the spring and container will be out of the paths of electron beams issuing from the mount assembly and not interfere with the operation of the tube. The getter material, typically a barium-aluminum alloy, has the property of sorbing gases remaining after exhausting the tube, or those later released by the walls of the tube, or by structural components therein. In both cases, the getter material acts as an auxiliary pump which provides the high vacuum needed for effective operation of the tube.

The getter material in the metallic container is flashed by positioning an rf (radio frequency) induction heating coil proximate that exterior surface of the cathode-ray tube which is opposite, or closely adjacent, the getter container, and then energizing the coil with an rf current. The alternating magnetic field generated by the energizing heating coil induces a current flow in the metallic getter container, heating the container and its contents to a high enough temperature to flash the contained getter material. In order to vaporize the maximum amount of getter material from the container and to realize a desired distribution of deposited getter material in the tube, it is necessary to position the heating coil properly with respect to the getter container so as to produce optimum magnetic coupling between them. The coil position is critical because the power delivered to the getter container varies with the inverse square of the distance between the coil and the container. Planar alignment between the container and the coil is also critical in order to properly intercept the transverse electric field, which is what heats the container. Misalignment may also cause severe localized heating which melts or softens the getter container and/or support spring, resulting in an unsatisfactory getter flashing step.

The getter flashing step is typically performed along a production line where a robot, or operator, places the cathode-ray tube into a fixture which holds the tube adjacent to a getter flasher. The presence of the tube in the fixture starts an rf generator which delivers power to a heating coil in the getter flasher. Since the fixture is designed for the rapid loading of many tubes which move along the production line at a high rate, a particular tube may not be properly seated in the fixture, causing the getter container and the heating coil to be out of alignment with each other. Also, slight changes in the contour of either the tube or position yoke, a hand-made part (which varies from one fixture to the next) on which the tube rests in the fixture, may result in the heating coil being improperly positioned with respect to the getter container. The present invention provides a getter flasher having a self-centering heating coil which is able to properly position itself with respect to the getter container in funnel-shaped tubes of different sizes and/or shapes.

SUMMARY OF THE INVENTION

The present invention comprises a getter flasher having a movable, self-centering coil enclosure including an rf induction coil adapted to heat a getter container disposed within a cathode-ray tube and adjacent to a funnellike surface thereof. The coil enclosure is supported by a holder and has a spring coupled thereto for moving the coil enclosure in a direction away from the holder. A surface of the coil enclosure has a contour substantially similar to a portion of the funnellike surface of the tube.

DETAILED DESCRIPTION OF THE PREFERRED EMBODIMENT

Figure 1:
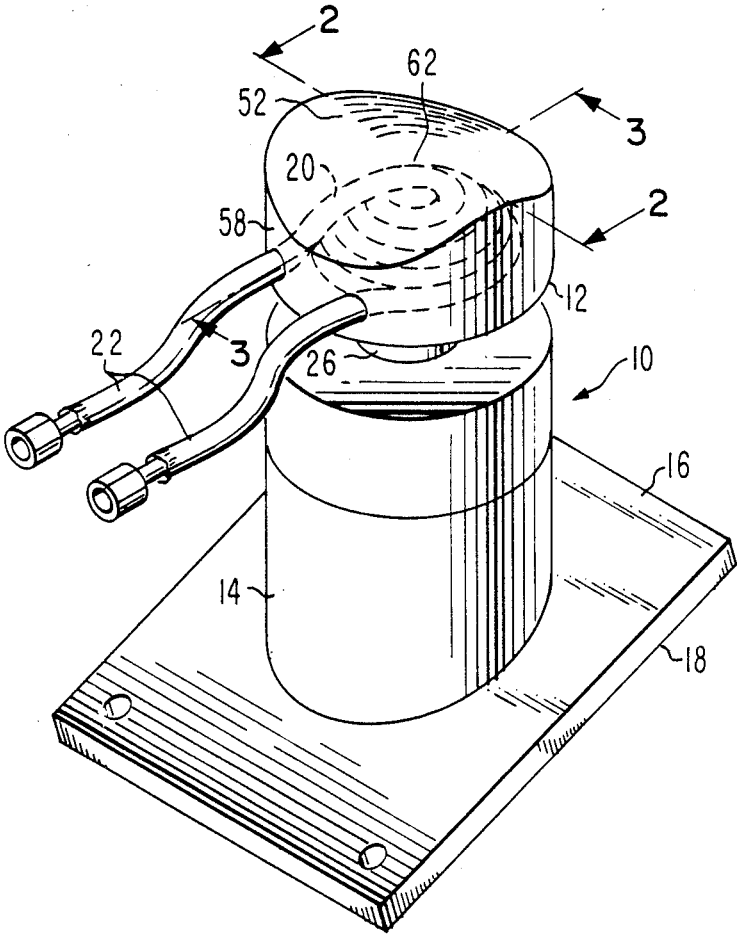
FIG. 1 is a side perspective view illustrating a preferred embodiment of the present getter flasher.
Figure 4:
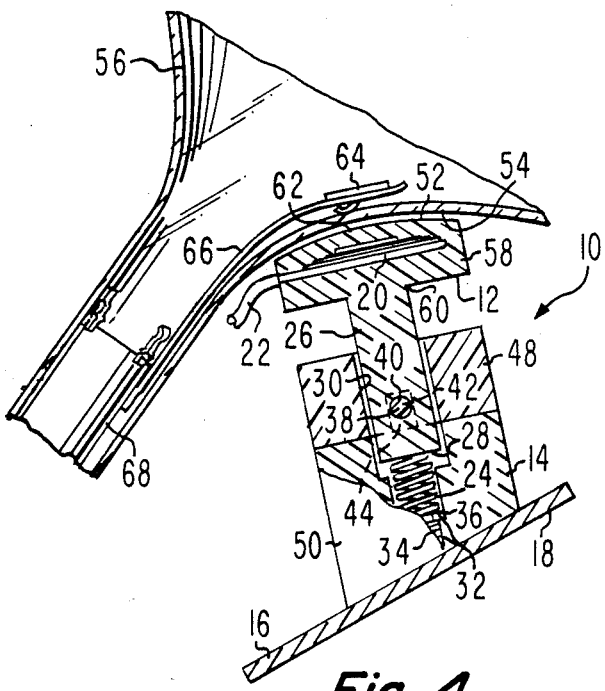
FIG. 4 is a cross-sectional view illustrating part of a cathode-ray tube adjacent the preferred embodiment.

FIG. 1 of the drawings shows a getter flasher 10 having a coil enclosure 12 supported by a holder 14. The holder 14 is mounted on a base 16 by screws (not shown) which pass through the base 16 from a bottom surface 18 thereof and into the holder 14. In the preferred embodiment, the holder 14 is cylindrically shaped and mounted on the base 16 at an angle of about 16 degrees from its cylindrical axis, as shown in FIG. 1, for positioning in a tube-holding fixture, as explained further below. The coil enclosure 12 has an rf (radio frequency) induction heating coil 20 disposed therein and external leads 22 extending therefrom for providing power to the coil 20. The coil 20 is adapted to heat a getter container disposed within a cathode-ray tube and adjacent to a funnellike surface thereof, as illustrated in FIG. 4.

Figure 3:
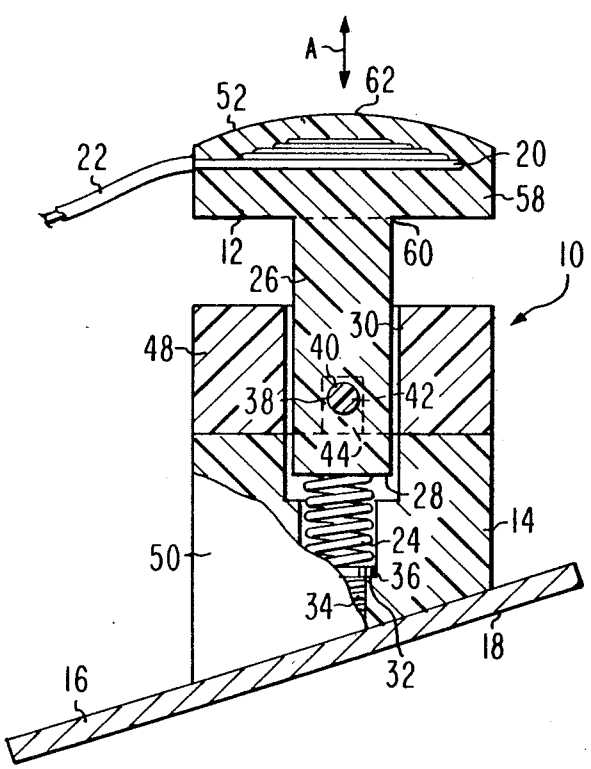
FIG. 3 is a partial cross-sectional view taken along ine 3—3 of FIG. 1.
Figure 2:
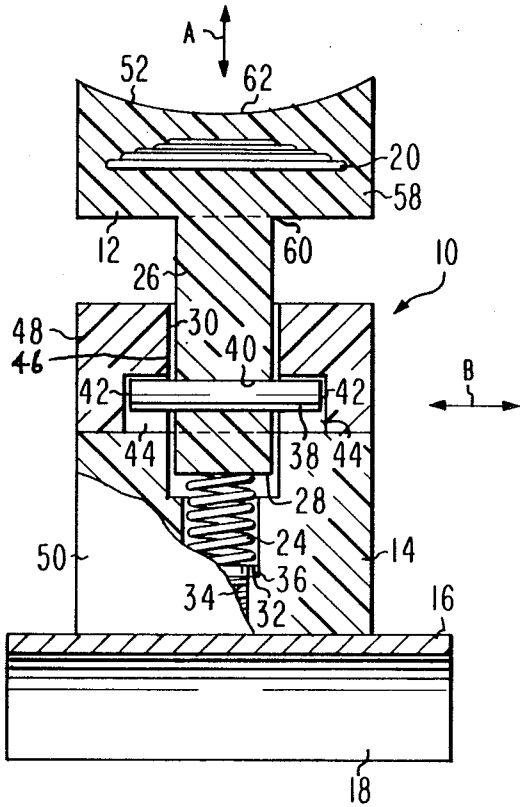
FIG. 2 is a partial cross-sectional view taken along line 2—2 of FIG. 1.

In FIGS. 2 and 3, resilient means 24, such as a coil spring, is coupled to the coil enclosure 12 for moving the coil enclosure 12 with respect to the holder 14. Preferably, the coil enclosure 12 includes a stem 26 having one end 28 located within a cavity 30 disposed in the holder 14. The resilient moving means 24 is positioned between a bottom surface 32 of the cavity 30 and the one end 28 of the stem 26 so as to move the stem 26 in a direction oriented along a longitudinal axis, shown by arrow A in FIGS. 2 and 3. In the preferred embodiment, the resilient moving means 24 comprises a spiral compression spring biased to move the coil enclosure 12 in a direction away from the holder 14. Compression on the spring is adjusted by turning a screw 34, which is positioned within the holder 14 along the longitudinal axis and is accessable through the bottom surface 18 of the base 16. A washer 36 is spaced between the screw 34 and the end of the spring distant from the one end 28 of the stem 26.

The cavity 30 should be sufficiently larger than the stem 26 so as to provide a clearance therebetween allowing the stem 26 to tilt within the cavity 30. Both the stem 26 and the cavity 30 may be shaped similar to a right circular cylinder having the height thereof oriented along a direction substantially parallel to the longitudinal axis. In the preferred embodiment, the diameters of the cavity 30 and stem 26 are, respectively, about 2.5 centimeters and about 3.0 centimeters, thereby allowing a tilt angle of at least two degrees with respect to the longitudinal axis. The base 16 of the getter flasher 10 may be fabricated from a synthetic resin material, such as that obtained by the condensation of formaldehyde with phenols.

The stem 26 may have means associated therewith for stopping the movement of the stem 26 in a direction along the longitudinal axis at a location distant from the holder 14. Preferably, the stopping means is positioned such that the spring is still biased when the stem 26 is at the stopped location. FIGS. 2 and 3 illustrate the preferred stopping means comprising a pin 38 attached to the stem 26 and oriented along a transverse axis, shown by arrow B, which intersects the longitudinal axis. The pin 38 is inserted through an aperture 40 in the stem 26 and held thereat by a press fit. The ends 42 of the pin project from the stem 26 into slots 44 disposed adjacent a side surface 46 of the cavity 30. The slots 44 extend in a direction oriented along the longitudinal axis so as to allow the ends 42 to move in that direction. The pin 38 prevents the stem 26 from leaving the cavity 30 and also keeps it from rotating significantly about the longitudinal axis. The stopping means is built into the getter flasher 10 by actually forming the cylindrical holder 14 with a distinct top half 48, which is integrally separate from a bottom half 50 and subequently attached thereto by screws (not shown) which pass through the base 16, the bottom half 50 and into the top half 48.

In FIG. 4, a surface 52 of the coil enclosure 12 has a contour substantially similar to a portion 54 of a funnellike surface of a cathode-ray tube 56. The contoured surface 52 of the coil enclosure 12 forms a saddle 58 disposed at the other end 60 of the stem 26. The heating coil 20 is potted in the saddle 58 in an orientation such that the longitudinal axis passes through the center of the coil 20. Preferably, the saddle 58 is oriented so that a central portion 62 thereof is substantially orthogonal to the longitudinal axis. The contoured surface 52 allows the saddle 58, including the coil 20 therein, to match itself to the funnellike portion 54 of the tube 56 and, thereby, place the coil 20 at a specific orientation with respect to a getter container 64 within the tube 56, which is held adjacent to the funnellike portion 54 by a spring 66 attached to a mount assembly 68.

The material of the saddle 58 may comprise a linear polyoxymethylene-type acetal resin which is made by the polymerization of formaldehyde and formed from a mold having a contour shaped similar to the contour of the funnellike portion 54. The mold may be formed by pressing moldable clay adjacent the funnellike portion 54, removing it, and then forming the mold around the clay. Since the present novel getting flasher 10 is designed to position itself with respect to the getter container in funnel-shaped tubes of different sizes and/or shapes, the clay should be molded to accomodate the different tube sizes by assuming a contour which represents a compromise between the slightly different contours of the tubes at the funnellike-portion location.

Figure 5:
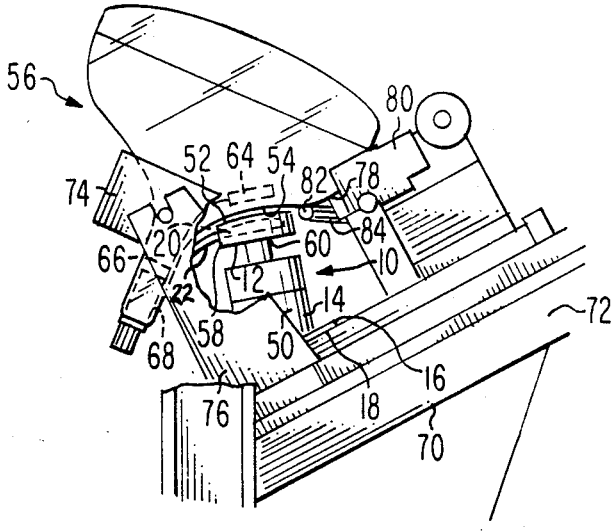
FIG. 5 is a side view illustrating the preferred embodiment installed in a getter flashing fixture with a cathode-ray tube positioned thereon.

FIG. 5 shows a tube-holding fixture 70 which supports the cathode-ray tube 56 adjacent to the getter flasher 10. The base 16 of the getter flasher 10 is bolted to a support platform 72 of the fixture 70, which is inclined at an angle of approximately 22 degrees, and is positioned so that the saddle 58 thereof contacts the tube 56 as explained below. The fixture 70 has a position yoke 54 into which a robot or operator places the tube 56 from a conveyor (not shown) along a production line. The yoke 74 is pivotally supported on a pair of arms 76 attached to the platform 72, and has an aperture in the center thereof through which the saddle 58 of the coil enclosure 12 projects and moves freely therein.

After the cathode-ray tube 56 is placed into the position yoke 74 of the fixture 70, a side 78 of the tube 56 comes to rest against a support block 80 attached to the platform 72. During this operation, the funnellike portion 54 of the tube 56 contacts the saddle 58 and moves the coil enclosure 12 toward the holder 14. This movement of the contoured coil enclosure 12, coupled to the resilient means 24, properly aligns the heating coil 20 with respect to the getter container 64, so as to produce optimum magnetic coupling therebetween. Simultaneously, the side 78 of the tube 56 contacts a wheel 82 of a depressable lever 84 and causes the lever 84 to rotate until a position is reched at which an rf generator is started for delivering power to the heating coil 20. The getter container 64 is then heated, causing the getter material contained therein to flash.

The cooperative combination of the resilient means 24 together with the contoured surface 52 of the saddle 58 provides a self-centering effect which causes the stem 26 to tilt within the cavity 30 and, thereby, places the heating coil 20 in the proper position with respect to the getter container 64 as the cathjode-ray tube 56 comes to rest against the support block 80. In other words, as the coil enclosure 12 moves toward the holder 14, the contoured surface 52 of the saddle 58 matches itself to the funnellike portion 54 of the tube 56, causing the heating coil 20 to assume an angle of tilt as needed to match the tube 56. Since the getter container 64 is held in substantially the same position with respect to the funnellike portion 54 in tubes of different sizes, the getter flasher 10 is able to align the heating coil 20 properly with respect to the getter container 64 in different size tubes along the same production line. In addition, the present getter flasher 10 may provide a better way of detecting the tube presence to start the rf generator by having the generator wait until the movable coil enclosure 12 has been moved a predetermined distance, thus assuring that the heating coil 20 is positioned closely adjacent and in proper alignment with the getter container 64.

What is claimed is:

1. In a getter flasher having a coil enclosure supported by a holder, said coil enclosure including an induction heating coil oriented substantially parallel to a given plane and adapted to heat a getter container disposed within a cathode-ray tube and adjacent to a funnellike surface thereof, the improvement comprising:

resilient means coupled to said coil enclosure for moving said coil enclosure with respect to said holder, and a surface of said coil enclosure having a contour substantially similar to a portion of said funnellike surface of said tube, said coil being positioned within said coil enclosure such that said plane is substantially parallel to the getter container when said contoured surface is placed conformably adjacent said funnellike surface portion.

2. A getter flasher as defined in claim 1 wherein said coil enclosure includes a stem having one end located within a cavity disposed in said holder, and said resilient moving means is positioned between a bottom surface of said cavity and said one end of said stem to move said stem in a direction oriented along a longitudinal axis.

3. A getter flasher as defined in claim 2 wherein said cavity is sufficiently larger than said stem to provide a clearance therebetween allowing said stem to tilt within said cavity.

4. A getter flasher as defined in claim 3 wherein both said stem and said cavity are shaped similar to a right circular cylinder having the height thereof oriented along a direction substantially parallel to said longitudinal axis.

5. A getter flasher as defined in claim 4 wherein the diameters of said cavity and said stem are, respectively, about 2.5 centimeters and about 3.0 centimeters, thereby allowing a tilt angle of at least two degrees with respect to said longitudinal axis.

6. A getter flasher as defined in claim 2 wherein the contoured surface of said coil enclosure forms a saddle disposed at the other end of said stem, said coil being potted in said saddle in an orientation such that said longitudinal axis passes through the center of said coil.

7. A getter flasher as defined in claim 6 wherein said saddle is orientated so that a central portion thereof is substantially orthogonal to said longitudinal axis.

8. A getter flasher as defined in claim 7 wherein said saddle comprises an acetal resin.

9. A getter flasher as defined in claim 2 wherein said resilient moving means comprises a spiral compression spring biased to move said coil enclosure in a direction away from said holder.

10. A getter flasher as defined in claim 9 wherein said stem has means associated therewith for stoping the movement of said stem in a direction along said longitudinal axis at a location distant from said holder.

11. A getter flasher as defined in claim 10 wherein said stopping means is positioned such that said spring is still biased when said stem is at the stopped location.

12. A getter flasher as defined in claim 11 wherein said stoping means comprises a pin attached to said stem and oriented along a transverse axis intersecting said longitudinal axis, the ends of said pin projecting from said stem into slots disposed adjacent a side surface of said cavity, said slots extending in a direction oriented along said longitudinal axis so as to allow said ends to move in a direction oriented along said longitudinal axis.

* * * * *

UNITED STATES PATENT AND TRADEMARK OFFICE
CERTIFICATE OF CORRECTION

PATENT NO. : 4,584,449

DATED : April 22, 1986

INVENTOR(S) : William James Timmons

It is certified that error appears in the above-identified patent and that said Letters Patent is hereby corrected as shown below:

Column 3, line 65, "getting" should be -- getter --.

Column 4, line 11, "54" should be -- 74 --.

Signed and Sealed this

*Twenty-third* Day of *September 1986*

[SEAL]

*Attest:*

DONALD J. QUIGG

*Attesting Officer* *Commissioner of Patents and Trademarks*